United States Patent [19]

Brauner et al.

[11] 4,061,313

[45] Dec. 6, 1977

[54] APPARATUS FOR THE STATIC MIXING OF FLOWABLE SUBSTANCES

[75] Inventors: Dieter Brauner, Solingen-Wald; Hans-Joachim Kaluza, Cologne; Edgar Muschelknautz, Leverkusen, all of Germany

[73] Assignee: Bayer Aktiengesellschaft, Leverkusen, Germany

[21] Appl. No.: 700,645

[22] Filed: June 28, 1976

[30] Foreign Application Priority Data

July 19, 1975 Germany ..... 2532355

[51] Int. Cl.[2] ..... B01F 15/02

[52] U.S. Cl. ..... 366/340

[58] Field of Search ..... 259/4 R, 4 AC, 4 AB, 259/4 A, 18, 36; 138/38, 42

[56] References Cited

U.S. PATENT DOCUMENTS

| | | | |
|---|---|---|---|
| 3,406,947 | 10/1968 | Harder | 259/4 AB |
| 3,620,506 | 11/1971 | Stephen | 259/4 AB |
| 3,865,352 | 2/1975 | Nelson | 259/4 AB |
| 3,923,288 | 12/1975 | King | 259/4 AB |

FOREIGN PATENT DOCUMENTS

| | | | |
|---|---|---|---|
| 630,401 | 11/1961 | Canada | 259/4 AB |
| 298,440 | 11/1965 | Netherlands | 259/4 AB |

*Primary Examiner*—Robert W. Jenkins

*Attorney, Agent, or Firm*—Burgess, Dinklage & Sprung

[57] ABSTRACT

For the static mixing of flowable substances a tubular housing is used having a mixing insert therein, consisting of a plurality of plates having webs in intersecting planes inclined to the axis of the housing, between which slots are provided, the free spaces within the housing being filled with packing material.

5 Claims, 2 Drawing Figures

APPARATUS FOR THE STATIC MIXING OF FLOWABLE SUBSTANCES

Figure 1:
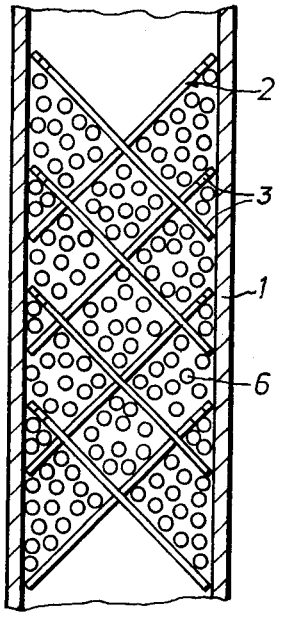

The invention relates to an apparatus for the static mixing of flowable substances comprising a tubular housing having a mixing insert arranged therein, consisting of a plurality of plates having webs in intersecting planes inclined to the axis of the housing.

Such apparatuses have the purpose of mixing intimately continuously flowing substances for homogenisation, reaction or heat exchange.

These apparatuses permit good homogenisation with low pressure loss and low shearing effects. The residence time distribution is, however, relatively broad, in particular with longer mixing sections, depending on the type of construction of the mixer.

An apparatus for mixing foam with solid material is known in which a drivable perforated spiral is arranged in a tubular housing. The free space of the housing is filled with packing material. The inlet and outlet of the housing are sealed by sieves whose mesh size is smaller than the size of the packing material. In this embodiment, to achieve a sufficient homogenisation, rotational movement of the spiral is necessary so that a sufficient transverse mixing takes place. Moving parts are disadvantageous because of the drive energy which must be applied, the wear and in particular because of the problems in respect of contamination involved in supporting the rotating parts. The residence time spectrum of the mixing material is fairly broad.

It is often necessary or desirable to achieve good homogenisation over a short mixing section with a narrow residence time spectrum and high shearing effect on the substances to be mixed.

This object is achieved according to the invention by filling the free spaces within the housing with packing material.

The result of this is that, in known manner, the mixing insert effects the mixing over the cross-section of the housing and the packing materials, depending on their surface form and number of edges lead to a corresponding volume limited fine distribution of the flowable substances. Contrary to all expectations it has proved that the packing material in combination with the specified mixing insert does not effect and deterioration of the transverse mixing effect, but does achieve the desired high shearing effect.

In principal, suitable packing materials are all those which can be used in packed towers. Naturally, the size of the packing material is dependent on the free cross-section of the housing and on the type of substances to be mixed. If reactions are to take place, the packing materials can optionally be produced from a material which acts as a catalyst. Normally however the material of the packing material should not influence the reaction. For smaller housing diameters, sand, glass beads or granulate of corresponding grain size are suitable, and for larger housing diameters, insofar as permitted by the remaining free space between or in the region of the mixing insert, suitable materials are those such as described in Ullmann's Enzyklopadie der technischen Chemie, 3. Auflage, 1. Band, Chemischer Apparatebau und Verfahrenstechnik Urban & Schwarzenberg, Munich, Berlin, 1951 on page 441 in illustration 683. Here reference is made to inclined film sheets, Stedman bodies, Berl saddles, Raschig rings, ceramic rings with fittings, Haltmeier rolls, twin bodies, Intos rings, glass or wire mesh rings, Wilson spirals, Brunswick coils and Prym rings.

If the slots between the webs are so narrow that the packing material cannot slip through, it is possible to retain the packing material charge by means of the mixing insert itself. However, if the packing material is smaller in diameter than the width of slots, then obviously the packing material charge must be retained in the housing by known sieve fittings, such as grilles or sieves, of which the mesh size is smaller than the size of the packing material, in order to avoid the packing material being washed away by the substances flowing through the housing.

Of course, not only packing materials of the same type and size can be used, but also those of differing type and size at the same time. By the corresponding design of the packing material charge according to the last mentioned embodiment, the flow conditions within the mixing apparatus can easily be influenced in the desired manner. Different flows can also be achieved by filling the spatial sections formed between the plates forming the mixing insert partially, not at all or to varying degrees.

Figure 2:
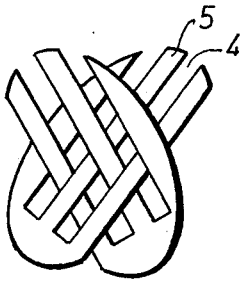

An embodiment of the apparatus according to the invention is shown in the accompanying drawings, in which:

FIG. 1 shows a section through an embodiment of an apparatus according to the invention; and FIG. 2 shows a perspective view of a mixing insert.

As shown in FIG. 1, a mixing insert 2 is arranged in a housing 1 consisting of a plurality of plates 3 intersecting at 45° to the axis of the housing. These plates 3 (FIG. 2) are provided with interpenetrating slots 4 and webs 5. The chambers lying between them are filled with packing material 6. The first and last pairs of plates of the mixing insert serve as a limit for the packing material charge 6.

EXAMPLE 1

The apparatus shown in FIG. 1 is used. The length of the mixing device is 60 mm; the internal diameter of the housing is 15 mm. The mixing insert consists of 4 pairs or plates having webs and slots each 1.7 mm in width.

A substance having a viscosity of approximately 1,000 Poise and a density of approximately 1 g per $cm^3$ is to be homogenised as well as possible in respect of residence time and temperature. If the above described device is used without packing material, then for a measurement sample volume of 2 $mm^3$ a standard deviation of 7% is obtained. However if the mixing insert is filled with sand as a packing material having an average grain size of from 400 to 500 $\mu m$, then surprisingly a standard deviation of approximately 0.5% can be obtained. Thus for a throughput of 0.3 kg per hour, a pressure drop of approximately 165 bars is produced.

If a packing material layer of 60 mm in height were used without a mixing insert, a standard deviation of between 20 and 40% would be obtained.

EXAMPLE 2

The device shown in FIGS. 1 and 2 is also used. The length of the mixing section is 590 mm and its diameter is 50 mm. A substance having a viscosity of 60 Poise and a density of 1.377 g per $cm^3$ is mixed with small proportions of two low viscosity immiscible components in a quantity of 5.4 kg per hour. If no packing materials are used, in a measurement sample of 2 $mm^3$, a standard deviation of 0.4% is achieved. If packing material rings are used with an external diameter of 2.03 mm, an internal diameter of 1.5 mm and a height of 1.84 mm, then for a total presure loss of 8 bars a standard deviation of 0.06% is obtained.

However if the packing material charge is used alone without a mixing insert, then a standard deviation of 4.8% is obtained.

What we claim is:

1. An apparatus for the static mixing of flowable substances, comprising a tubular housing having a mixing insert arranged therein consisting of a plurality of intersecting plates disposed cross-wise and inclined with respect to the longitudinal axis of the housing, each of said plates having a plurality of alternating webs and slots and packing material filling in the free spaces between the plates and the portion of the mixing insert surrounded by the housing.

2. An apparatus as claimed in claim 1, wherein the packing material is larger than the width of the slots.

3. An apparatus as claimed in claim 2, wherein different types and/or sizes of packing material are arranged in different spaces within the housing, the spaces being separated from each other by the plates.

4. An apparatus as claimed in claim 1, wherein the packing material is smaller than the width of the slots, and the packing material is retained in the housing by means of grilles or sieves.

5. An apparatus according to claim 1, wherein each plate intersects with at least one other plate with the webs and slots interdigitated and with the planes of intersecting plates substantially perpendicular to each other.

* * * * *